US005086494A

United States Patent [19]

Wang

[11] Patent Number: 5,086,494

[45] Date of Patent: Feb. 4, 1992

[54] LEAK PROOF HUMIDIFIER

[75] Inventor: Jui-Shang Wang, Taipei, Taiwan

[73] Assignee: Duracraft Corporation, Sudbury, Mass.

[21] Appl. No.: 624,850

[22] Filed: Dec. 10, 1990

[51] Int. Cl.[5] ..... F22B 1/28

[52] U.S. Cl. ..... 392/405; 392/394

[58] Field of Search ..... 392/394, 403, 405, 406; 422/305, 306, 125

[56] References Cited

U.S. PATENT DOCUMENTS 4,810,854 3/1989 Dursich ..... 392/405

*Primary Examiner*—Teresa J. Walberg

*Attorney, Agent, or Firm*—John E. Toupal; Harold G. Jarcho

[57] ABSTRACT

A humidifier includes a base defining a water reservoir and a cavity for receiving leakage, a device for inducing dispersal of water in the reservoir, and a tank removably supported by the base and having a bottom wall defining a discharge opening communicating with the reservoir and an inlet opening communicating with the cavity. A wall surrounding the inlet opening and extending from the tank into the cavity intercepts leakage which is directed into the reservoir.

26 Claims, 2 Drawing Sheets

FIG. 2
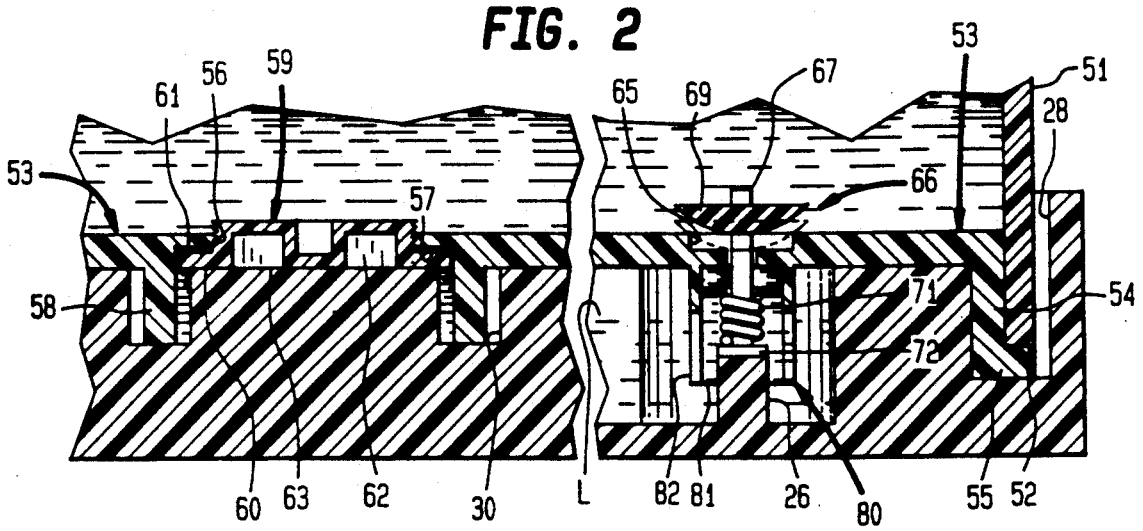
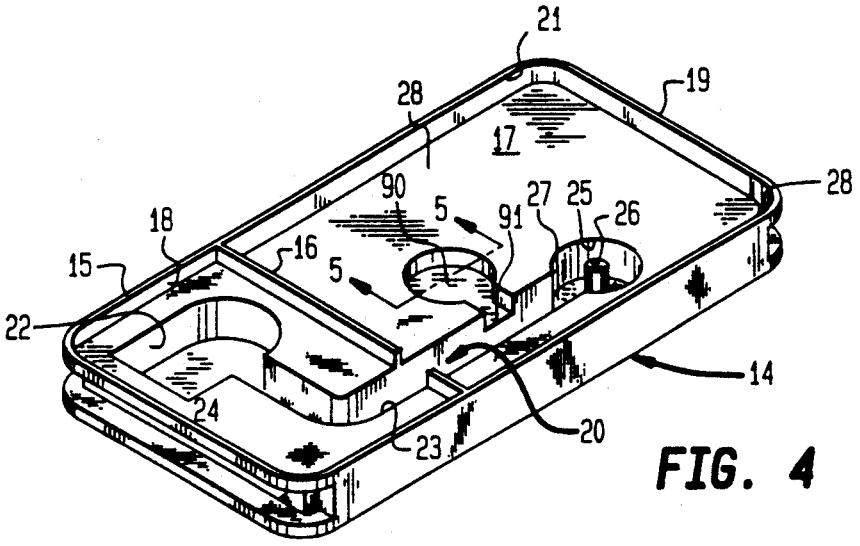
FIG. 4
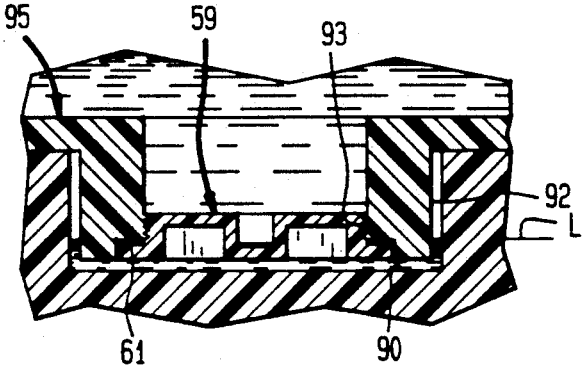
FIG. 5
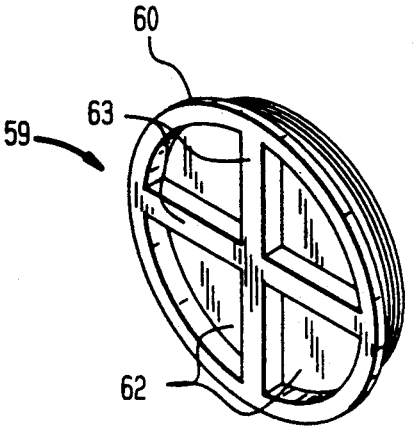
FIG. 3

LEAK PROOF HUMIDIFIER

BACKGROUND OF THE INVENTION

This invention relates generally to a humidifier and, more particularly, to a leak proof humidifier.

Many present day humidifiers employ bases that define a liquid filled reservoir in which water is heated to evaporation temperature by a suitable heating unit. Water is usually supplied to the reservoir by a tank removably supported by the base. Typically, the supply tank includes a bottom wall that defines a fill opening and a discharge spout that projects downwardly into the liquid reservoir in the base. During use, the supply tank is filled with water through the fill opening which is then closed by a removable cap. The filled tank is then inverted and positioned on the base after which water is supplied to the base reservoir through the discharge spout. The level of water maintained in the base reservoir is determined by the projection thereinto of the discharge spout and existing fluid dynamics of the system including weight of water in the tank, surface tension of water, vacuum pressure produced in the tank, atmospheric pressure above the liquid in the base reservoir, etc. When the water level in the reservoir drops below a predetermined desired level a pressure imbalance evolves across the discharge spout allowing air to enter the tank and a resultant water discharge therefrom to again create a pressure equalization and the desired water level. However, inadvertent water leakage through the removable cap in the fill opening will produce an undesirable increase in water level that can result in water spillage and inefficient humidifier operation.

The object of this invention therefore, is to provide an improved humidifier having a leak proof water supply tank.

SUMMARY OF THE INVENTION

The invention is a humidifier including a base defining a reservoir adapted to retain water to be evaporated and a cavity adapted to receive leakage; an evaporator for inducing evaporation of water retained by the reservoir; a tank removably supported by the base and having a bottom wall defining a discharge opening communicating with the reservoir and an inlet opening communicating with the cavity; and wall means surrounding the inlet opening and extending from the tank into the cavity. Liquid in the cavity produces a seal that prevents undesirable leakage from the inlet opening.

According to certain features of the invention, the humidifier includes a removable cap closing the inlet opening and the wall means is integrally formed with the tank. The cap simplifies use of the humidifier and the integral wall reduces cost.

According to other features of the invention, the wall means form a tube projecting downwardly from the inlet opening into the cavity, and the humidifier includes a skirt surrounding the discharge opening and projecting downwardly into the reservoir so as to establish a given water level therein. The downwardly projecting wall means establishes for the inlet opening a liquid seal below the bottom wall of the humidifier.

According to yet another feature of the invention, the tube projects to substantially the bottom of the cavity and to a level below the given water level. The tube produces the leakage seal below the water level desired in the reservoir.

According to one embodiment of the invention, the cap is removably retained in the bottom wall and the tube surrounds the cap and projects downwardly therefrom into the cavity. The tube in this embodiment creates a sealed volume below the cap that prevents leakage therefrom.

In a featured embodiment, the cavity is annular and conforms substantially to the tube. The conforming annular tube minimizes the volume required to create a seal.

According to another embodiment of the invention, the cap is removably retained by the end portion of the tube. In this embodiment the cap is disposed by the tube at a level below the tank bottom.

According to still another feature of the invention, the cavity communicates with the reservoir. This feature establishes a liquid seal at the water level desired for the base reservoir.

The invention further encompasses a humidifier including a base defining a reservoir adapted to retain water to be evaporated and a recess adapted to receive leakage; an evaporator for inducing evaporation of water retained by the reservoir; a tank comprising a vessel having an open end sealed by a lid and forming a bottom wall for the vessel, the tank being supported by the base and the lid defining a discharge opening communicating with the reservoir; and a partition means surrounding the sealed lid and extending below the tank into the recess. The partition and recess establish a liquid seal that prevents leakage by the lid.

According to other features of this latter humidifier; the partition is integrally formed with the tank, and forms an enclosure projecting downwardly from the lid. The enclosure provides a seal that encompasses the periphery of the lid.

According to other features, the enclosure projects to substantially the bottom of the recess and conforms substantially thereto. These features provide a compact leakproof combination supply tank and base.

DESCRIPTION OF THE DRAWINGS

These and other objects and features of the invention will become more apparent upon a perusal of the following description taken in conjunction with the accompanying drawings wherein:

FIG. 2 is a cross-sectional view taken along lines 2—2 of FIG. 1;

FIG. 3 is a perspective view of a cap shown in FIG. 2;

FIG. 4 is a perspective view of a modified base; and

FIG. 5 is a cross sectional view taken along lines 5—5 of FIG. 4.

DESCRIPTION OF THE PREFERRED EMBODIMENT

Figure 1:
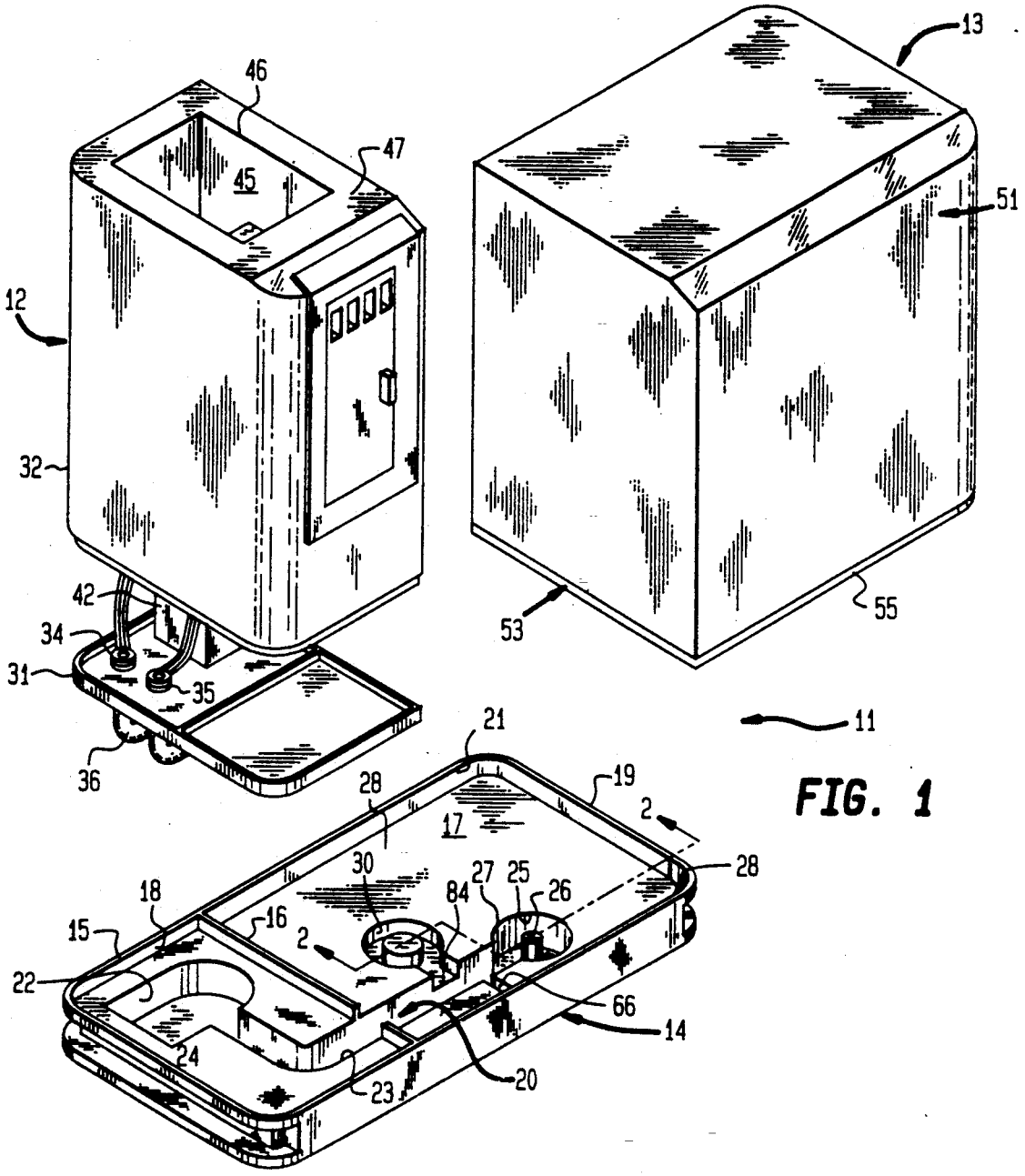
FIG. 1 is an exploded perspective view of a humidifier in accordance with the invention.

A humidifier 11 (FIG. 1) includes an evaporation unit 12 and a liquid supply tank 13 each removably mounted side by side on a base 14. A peripheral skirt portion 15 and a divider wall 16 project upwardly from an upper surface 17 of the base 14 and define an evaporator enclosure 18 for removably receiving the evaporation unit 12. Similarly a peripheral skirt portion 19 projecting upwardly from the upper surface 17 and the divider wall 16 define a tank enclosure 21 for removably receiving the supply tank 13.

Formed in the base 14 and below the base surface 17 is a reservoir 20 that includes a boiler cavity 22 disposed within the enclosure 18. Also included in the reservoir 20 is a liquid supply channel 23 having an outlet end 24 communicating with the boiler cavity 22 and an inlet end 25 located within the tank enclosure 21. A valve actuator stem 26 projects upwardly from a bottom 27 of the liquid supply channel into the inlet end 25. Also formed in the base 14 are a rectangularly shaped recess 28 disposed adjacent to the peripheral portion 19 and divider wall 16 and a circular annular, cylindrical cavity 30 both extending below the surface 17.

The evaporation unit 12 includes a bottom plate 31 and an enclosure 32 supported thereby. Supported by electrical terminals 34, 35 on the bottom plate 31 and extending downwardly therefrom is an evaporator heater coil 36 that projects into the boiler cavity 22 in the base 14. A rectangular tube 42 extends upwardly from the bottom plate 31 over an opening (not shown) communicating with the cavity 22. Established by the tube 42, and a duct portion 45 of the enclosure 32 is a vapor passage communicating between the cavity 22 and a discharge opening 46 in a top wall 47 of the housing 32. Energization of the humidifier coil 36 causes in the conventional manner evaporation of the liquid in the boiler cavity 22 and dispersal thereof out of the discharge opening 46.

The liquid supply tank 13 includes a vessel 51 having an open bottom 52 as shown in FIG. 2. Closing the open bottom 52 and providing a sealed bottom wall for the vessel 51 is a lid 53. A downwardly projecting rim 54 on the lid 53 engages an inner, lower partition surface of the vessel 51. The lower partition portion of the vessel 51 forms an enclosure surrounding the lid 53. A bottom edge 52 of the lower partition portion of the vessel 51 engages a flange 55 extending outwardly from the rim 54.

As shown in FIG. 2, the bottom wall 53 of the tank 13 defines a threaded inlet opening 56. A counter bore in the bottom wall 53 provides an annular shoulder 57. Extending downwardly from the bottom wall 53 and formed integrally therewith is an annular wall formed by a tube portion 58 that extends to the bottom of the annular cavity 30 in the base 14. Closing the inlet opening 56 is a threaded cap 59 having an outwardly projecting flange portion 60. A seal ring 61 is disposed between the flange portion 60 and the shoulder 57 of the bottom wall 53. Forming finger openings 62 in the cap 59 are divider portions 63 thereof shown most clearly in FIG. 3.

Also defined in the bottom wall 53 is a discharge opening 65. A valve assembly 66 is retained by the bottom wall 53 within the discharge opening 65. Included in the valve assembly 66 is a valve 69 retained on a stem 67 extending through the discharge opening 65. A spring 71 extending between a portion of the bottom wall 53 and a bracket 72 mounted on an end of the stem 67 normally biases the valve 69 into a seated position closing the discharge opening 65 as shown by dashed lines in FIG. 2. Projecting downwardly from the bottom wall 53 and enclosing a lower portion of the valve assembly 66 is a skirt 80 having an open bottom end 81 intersected by slots 82.

OPERATION

To prepare the humidifier 11 for use, the tank 13 is removed from the base 14 and filled with water through an opening created by removal of the cap 59. With the cap 59 replaced and the normally seated valve 69 seated in the opening 65, the sealed tank 13 is inverted and positioned on the base 14 within the tank enclosure 21. In that position, the sealed end of the tank 13 between the edge 52 of the vessel 51 and the flange 55 on the lid 53 extends to the bottom of the recess 28 and below the water level L established by a passage 66 (FIG. 1) between the reservoir 20 and the recess 28. Engagement of the bracket 72 on the valve stem 67 with the actuator stem 26 on the base 14 moves the valve 69 into an open position as shown by solid lines in FIG. 2. Accordingly, water from the tank 13 flows through the opened valve 69, the inlet end 25 and the liquid supply channel 23 into the boiler cavity 22. As long as a supply of water exists in the sealed tank 13, a water level L determined by the height of the slots 82 in the skirt 80 will be retained by the open valve 69 within the reservoir 20 formed by the boiler cavity 22 and the liquid supply channel 23 because of pressure equalization across the discharge opening 65. With the tank 13 in position on the base 14, the sealed end of the tank 13 between the edge 52 of the vessel 51 and the flange 55 on the lid 53 extends to the bottom of the recess 28 and below the water level L established by a passage 66 (FIG. 1) between the reservoir 20 and the recess 28.

In the event that the cap 59 is not securely tightened in the inlet opening 56, water within the vessel 51 may leak by the seal ring 61. Any such leakage of water will be directed by the tube wall portion 58 into the annular cavity 30 in the surface 17 of the base 14. As shown in FIG. 2, the tube wall portion 58 extends to the bottom of the annular cavity 30 that communicates with the reservoir 20 via a passage 84. Thus, water in the cavity 30 at the level L will create a seal between the tube 58 and the bottom of the cavity 30. A resultant equalization of pressure across the seal 61 will prevent leakage out of the inlet opening 56.

In a similar manner, the invention will prevent leakage caused by a defective seal between the engaging surfaces of the vessel 51 and the outer periphery of the lid 53. Such leakage is received by the recess 28 that communicates with the reservoir 20 via the passage 66. Because the joint between the bottom edge 52 of the vessel 51 and the flange 55 on the lid 53 is disposed below the water level L, an equalization of pressure across that joint will prevent any leakage in the manner described above. However, even in the event of leakage through the joint, such leakage will be retained within the enclosure formed by the skirt portions 15 and 19 and deposited into the reservoir 20.

OTHER EMBODIMENT

FIGS. 4 and 5 illustrate another embodiment of the invention in which a circular well 90 formed in the base 14 communicates with the reservoir 21 via a passage 91. As shown in FIG. 5 a bottom wall 73 of a modified water tank 13 includes a downwardly projecting tube portion 92 that terminates with an inlet opening 93. Closing the inlet opening 93 is a cap 59 of the type described above. The tubular portion 92 projects downwardly from the bottom lid 95 to a level below the water level L established by the discharge opening 65.

Any leakage through the seal 61 is prevented by equalization of pressure across the opening 93.

Obviously, many modifications and variations of the present invention are possible in light of the above teachings. It is to be understood, therefore, that the invention can be practiced otherwise than as specifically described.

What is claimed is:

1. A humidifier comprising:

base means defining a reservoir adapted to retain water to be dispersed and a cavity adapted to receive leakage;

humidifier means for inducing dispersal of water retained by said reservoir;

tank means removably supported by said base means and having a bottom wall defining a discharge opening communicating with said reservoir and an inlet opening communicating with said cavity; and wall means surrounding said inlet opening and extending from said tank means into said cavity.

2. A humidifier according to claim 1 including a removable cap closing said inlet opening.

3. A humidifier according to claim 2 wherein said wall means is integrally formed with said tank means.

4. A humidifier according to claim 3 wherein said wall means form a tube projecting downwardly from said inlet opening into said cavity.

5. A humidifier according to claim 2 wherein said wall means form a tube projecting downwardly from said inlet opening into said cavity.

6. A humidifier according to claim 5 including skirt means surrounding said discharge opening and projecting downwardly into said reservoir, said skirt means adapted to establish a given water level therein.

7. A humidifier according to claim 6 including a valve means disposed in said discharge opening and adapted to produce said given water level in response to the differential pressure across said valve.

8. A humidifier according to claim 6 wherein said tube projects to substantially the bottom of said cavity.

9. A humidifier according to claim 8 wherein said tube comprises an outer end portion projecting into said cavity to a level below said given water level.

10. A humidifier according to claim 9 wherein said cap is removably retained in said bottom wall and said tube surrounds said cap and projects downwardly therefrom into said cavity.

11. A humidifier according to claim 10 wherein said cavity is annular and conforms substantially to said tube.

12. A humidifier according to claim 9 wherein said cap is removably retained by said end portion of said tube.

13. A humidifier according to claim 12 wherein said cavity is formed by a hollow cylindrical recess conforming substantially to said end portion of said tube.

14. A humidifier according to claim 1 wherein said cavity communicates with said reservoir.

15. A humidifier comprising:

base means defining a reservoir adapted to retain water to be dispersed and recess means adapted to receive leakage;

humidifier means for inducing dispersal of water retained by said reservoir;

tank means comprising a vessel having an open end and a lid sealed in said open end and forming a bottom wall for said vessel, said tank means being supported by said base means, and said lid defining a discharge opening communicating with said reservoir; and partition means surrounding said sealed lid and extending below said tank means into said recess means, said partition means forming an enclosure projecting downwardly from said lid.

16. A humidifier according to claim 15 wherein said partition means is integrally formed with said tank means.

17. A humidifier according to claim 15 including skirt means surrounding said discharge opening and projecting downwardly into said reservoir, said skirt means adapted to establish a given water level therein.

18. A humidifier according to claim 17 including a valve means disposed in said discharge opening and adapted to produce said given water level in response to the differential pressure across said valve.

19. A humidifier according to claim 18 wherein said enclosure projects to substantially the bottom of said recess means.

20. A humidifier according to claim 19 wherein said recess means is annular and conforms substantially to said enclosure.

21. A humidifier according to claim 20 wherein said lid further defines an inlet opening, said base means further defines cavity means, and including wall means surrounding said inlet opening and extending below said tank means into said cavity means.

22. A humidifier according to claim 21 including a removable cap closing said inlet opening.

23. A humidifier according to claim 22 wherein said wall means form a tube projecting outwardly from said inlet opening into said cavity.

24. A humidifier according to claim 23 wherein said tube projects to substantially the bottom of said cavity.

25. A humidifier according to claim 24 wherein said tube comprises an outer end portion projecting into said cavity to a level below said given water level, and said enclosure projects into said recess means to a level below said given water level.

26. A humidifier comprising:

base means defining a reservoir adapted to retain water to be dispersed and having an annular upwardly projecting annular skirt having an upper edge and defining an enclosure communicating with said reservoir;

humidifier means for inducing dispersal of water retained by said reservoir; and tank means comprising a vessel having an open end and a lid permanently sealed in said open end along a joint at the outer periphery of said vessel and forming a bottom wall for said vessel, said tank means being supported by said base means with said joint disposed below said upper edge such that leakage through said joint is retained by said skirt within said enclosure for deposit into said reservoir.

* * * * *